United States Patent [19]

Washut

[11] Patent Number: 4,793,517

[45] Date of Patent: Dec. 27, 1988

[54] PORTABLE PERSONAL LIQUID STORAGE AND DISPENSER UNIT

[76] Inventor: Harry E. Washut, 716 Val Vista, Sheridan, Wyo. 82801

[21] Appl. No.: 35,915

[22] Filed: Apr. 8, 1987

[51] Int. Cl.[4] ..... B65D 37/00; B67D 5/06

[52] U.S. Cl. ..... 222/129; 222/179.5; 222/180; 222/183; 222/191; 222/192; 222/212

[58] Field of Search ..... 222/94, 144.5, 179.5, 222/180, 181, 206, 212, 213, 129, 130, 131, 173, 183, 191, 192, 105, 106, 132, 556; 401/262; 248/311.2, 309.1, 313, 316.7; 15/244.4; 206/806; 215/6; 220/20

[56] References Cited

U.S. PATENT DOCUMENTS

| | | | |
|---|---|---|---|
| 1,310,609 | 7/1919 | DeWitt | 222/181 |
| 2,411,196 | 11/1946 | Dolan | 222/130 X |
| 2,611,499 | 9/1952 | Mayer | 215/6 |
| 2,765,576 | 10/1956 | Kurek | 220/20 X |
| 2,883,062 | 4/1959 | Rosemark | 211/60 |
| 2,946,154 | 7/1960 | Bornemann | 222/191 X |
| 3,078,016 | 2/1963 | Judy | 222/181 |
| 3,078,017 | 2/1963 | Waskonig et al. | 222/181 |
| 3,143,755 | 8/1964 | Rowley | 15/523 |
| 3,212,660 | 10/1965 | Adell | 248/313 |
| 3,276,067 | 10/1966 | Boyle et al. | 15/543 |
| 3,326,358 | 6/1967 | Singleton | 215/6 X |
| 3,342,379 | 9/1967 | Foley | 222/173 |
| 3,349,967 | 10/1967 | Schneller | 222/130 |
| 3,506,157 | 4/1970 | Dukess | 222/94 |
| 3,876,112 | 4/1975 | Kramer | 222/144.5 X |
| 3,920,160 | 11/1975 | Casale et al. | 222/162 |
| 3,990,611 | 11/1976 | Sojka | 222/135 |
| 4,148,417 | 4/1979 | Simmons | 222/94 |
| 4,166,553 | 9/1979 | Fraterrigo | 222/181 |
| 4,314,658 | 2/1982 | Laauwe | 222/213 |
| 4,470,523 | 9/1984 | Spector | 222/181 |
| 4,548,339 | 10/1985 | Gorman | 220/20 X |
| 4,611,716 | 9/1986 | Sorlien | 206/806 X |

*Primary Examiner*—Joseph J. Rolla
*Assistant Examiner*—S. B. Parker
*Attorney, Agent, or Firm*—Kinney & Lange

[57] ABSTRACT

A resilient bottle or container has three compartments for liquid soap, shampoo and conditioning rinse, respectively. A normally closed, openable valve controls a port in each compartment. The soap valve opens into the center of a sponge which is fastened to the bottle. The bottle can be supported on a vacuum cup on a shower wall for dispensing shampoo and conditioning rinse. On opening of any valve, manually depressing bottle, liquid is dispensed from the corresponding compartment.

8 Claims, 2 Drawing Sheets

PORTABLE PERSONAL LIQUID STORAGE AND DISPENSER UNIT

BACKGROUND OF THE INVENTION

1. Field of the Invention.

This invention has relation to a portable liquid storage and dispensing unit which can store fluids such as soap, shampoo, and conditioning rinse until needed; and can then be used to selectively dispense these fluids as needed during the bathing process.

2. Description of the Prior Art.

It is known to support a dispenser on a shower stall wall by suction cups, the dispenser having separate compartments for shampoo and rinse. See U.S. Pat. No. 3,920,160 to Casale et al. issued in November of 1975, FIGS. 4 and 6. Use of a suction cup to hold toilet articles is also shown in U.S. Pat. No. 2,883,062 issued to Rosemark in April of 1959.

Various manually pressure activated containers mounted on walls to dispense fluids are shown in the above mentioned patent to Rosemark and in the following U.S. Pat. Nos. 3,078,016 issued to Judy in February of 1963; 3,078,017 issued to Waskonig et al. in February of 1963; 4,166,553 issued to Fraterrigo in September of 1979; and 4,470,523 issued to Spector in September of 1984. This Spector patent shows a flexible, resilient container encompassing a single compartment containing liquid soap, the container being more or less permanently attached to a kitchen or bathroom wall by adhesive, the liquid being dispensed from the container by exerting manual pressure on it.

Combining a collapsible fluid container with a sponge is shown in U.S. Pat. No. 3,143,755 issued to Rowley in August of 1964 and in U.S. Pat. No. 3,276,067 issued to Boyle et al. in October of 1966.

Other patents cited in the search for this invention as being of general interest, but not showing the elements of this invention include U.S. Pat. No. 3,349,967 issued to Schneller in October of 1967 and U.S. Pat. No. 3,990,611 issued to Sojka in November of 1976.

What was needed before the present invention was a squeezable fluid contaienr with several compartments, each having its own closable outlet port made so that applying manual pressure to a resilient wall of the container will cause liquid to be dispensed from which ever one of its compartments was open.

Also, before this invention, there was no such structure accomplishing the purposes set out above which would, when the unit was positioned for storage, be so assembled that all outlet ports are situated so that they cannot be accidentally accessed and opened to the end that fluids from the container and from a sponge connected to the container cannot escape from the unit.

SUMMARY OF THE INVENTION

A unit for storage and dispensing of fluids includes a container which is at least partially resilient and which encompasses a plurality of separate, fluid tight, fluid containing compartments, these compartments being at least partially defined by flexible walls, and each compartment having a flexible or otherwise deformable wall in intimate contact with at least one of the other compartments. A normally closed, openable port extends from each of the compartments.

The container includes a resilient wall which is manually temporarily deformable to tend to reduce the volume of each compartment to develop a pressure in each compartment such that fluid will be dispensed through any compartment port that is open while the other ports remain normally closed.

In the form of the invention as shown, three compartments (containing liquid soap, shampoo, and a conditioning rinse, for example) are encompassed by a container which is resilient on top, bottom, and side walls and a front wall.

DETAILED DESCRIPTION OF THE PREFERRED EMBODIMENTS

Figure 1:
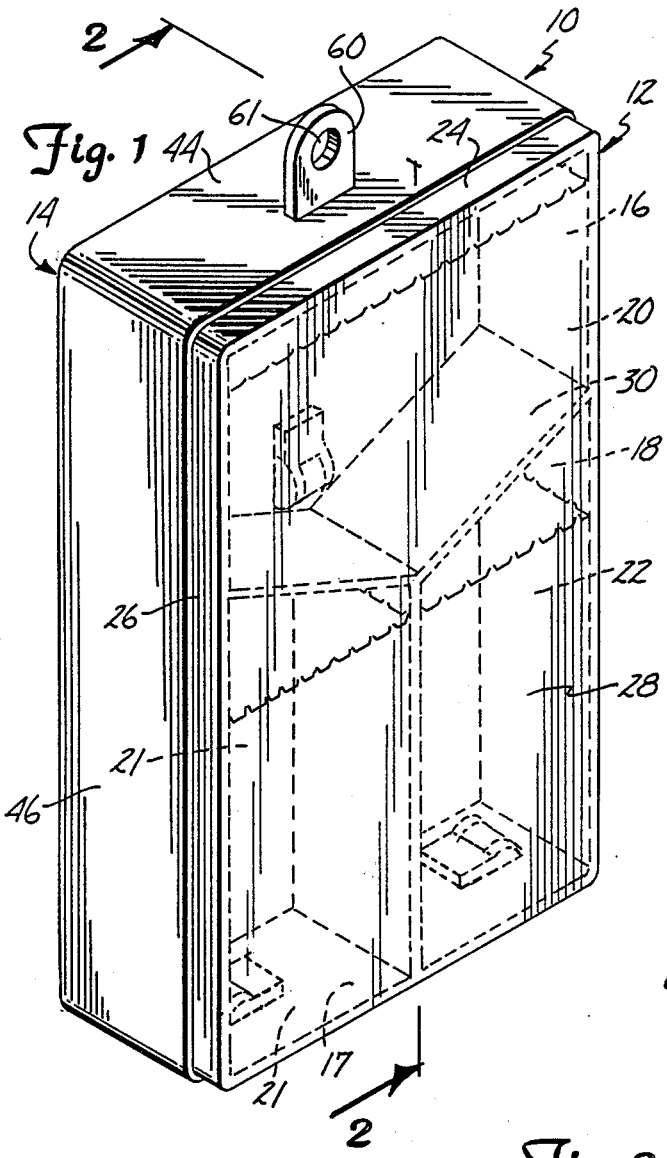
FIG. 1 is a perspective view of a storage and dispensing unit for fluids made according to the present invention.

A portable personal liquid storage and dispensing unit 10 includes a rectilinear container 12 of configuration to fit snugly inside of a rectilinear open face case 14. In the form of the invention as shown, this container encompasses three fluid tight compartments, namely, a liquid soap compartment 16, a shampoo compartment 17, and a creme rinse compartment 18. These compartments contain liquid soap 20, shampoo 21, and creme rinse 22, respectively. The unit of the invention would work satisfactorily if one or more of the compartments contained a fluid such as a paste, cream or gel, for example.

Rectilinear container 12 includes a resilient top wall 24, a resilient bottom wall 25, a first resilient side wall 26, a second resilient side wall 27, a resilient front wall 28, and a back wall 29.

In the form of the invention as shown, a resilient bifurcated wall 30 extending integrally between the container side walls 26 and 27, bottom wall 25, front wall 28 and back wall 29 separate the liquid tight compartments 16, 17 and 18 from each other.

A sponge 32 is permanently affixed to the back wall 29 in any usual or preferred manner, and is provided with a soap access opening 34 therethrough.

Each of the fluid tight, fluid containing compartments is provided with a port opening outwardly from that compartment. Soap compartment 16 is provided with a soap dispenser port 36 open to the soap access opening 34 in the sponge 32; shampoo compartment 17 is provided with a shampoo dispenser port 37; and creme rinse compartment 18 is provided with a creme rinse dispenser port 38.

Figure 5:
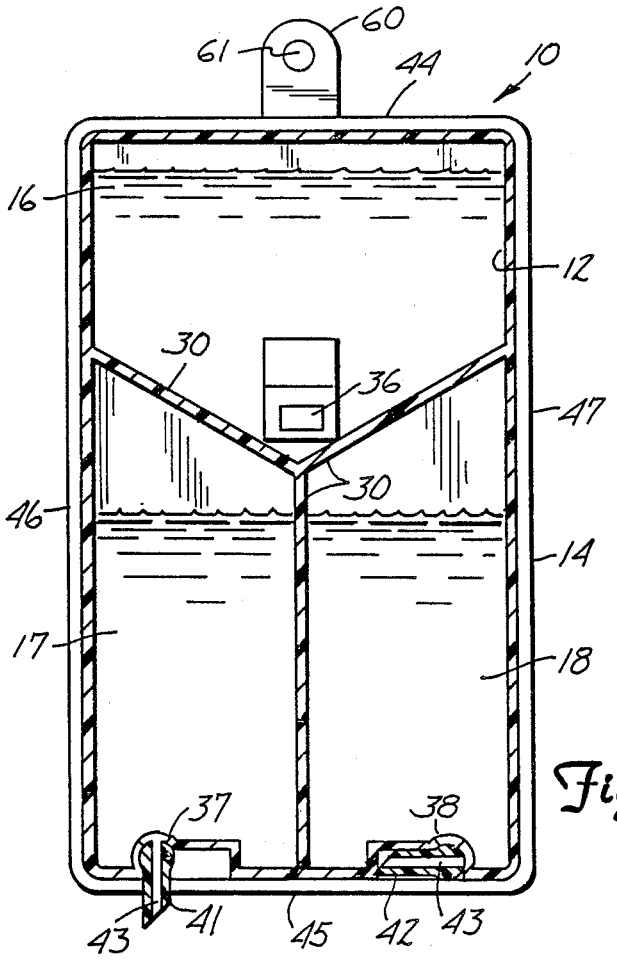
FIG. 5 is a vertical sectional view taken on the line 5—5 in FIG. 3.

Flow of fluids to be dispensed through each of these ports is controlled by an appropriate valve. Egress from port 36 is controlled by soap dispenser valve 40; egress from port 37 is controlled by shampoo dispenser valve 41; and egress from port 38 is controlled by creme rinse dispenser valve 42. The illustration of shampoo dispenser port 37 and valve 41 in open position and of creme rinse dispenser port 38 and valve 42 in closed position are typical. Each valve includes a partly cylindrical portion which is sealingly rotatably mounted in the bottom wall of the container 12 and is so constructed that when it is in its open position as seen to the left in FIG. 5, fluid can flow through port 37 and a central opening 43 provided in valve 41. As seen to the right in FIG. 5, when the creme rinse valve 42 is in its closed condition, it blocks creme rinse dispenser port 38 to prevent egress from creme rinse compartment 18 through valve opening 43. Many other appropriate structures could be used to control egress from ports 36, 37 and 38.

The rectilinear open face case 14 includes a top wall 44, a bottom wall 45, a first side wall 46, a second side wall 47, and a back wall 49. There is no front wall. The configuration of the case is such that each of the top, bottom and side walls will fit snugly into adjacent relationship with the corresponding wall of the rectilinear container 12.

Figure 2:
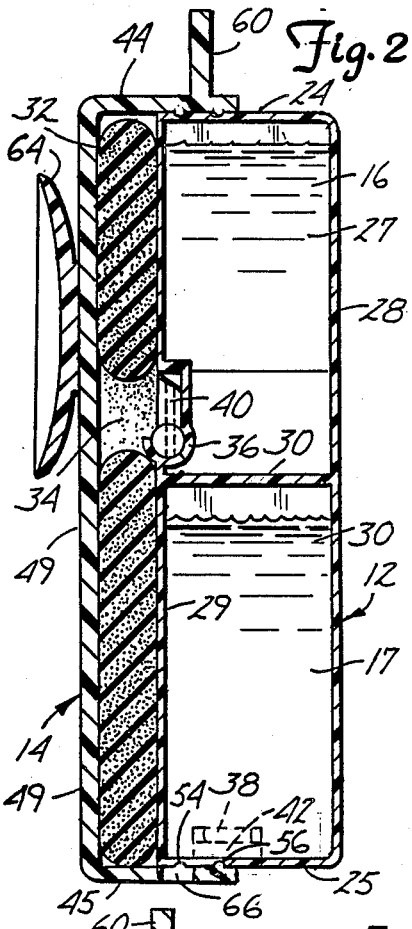
FIG. 2 is a vertical sectional view taken on the line 2—2 in FIG. 1 showing the unit in condition to be stored.
Figure 3:
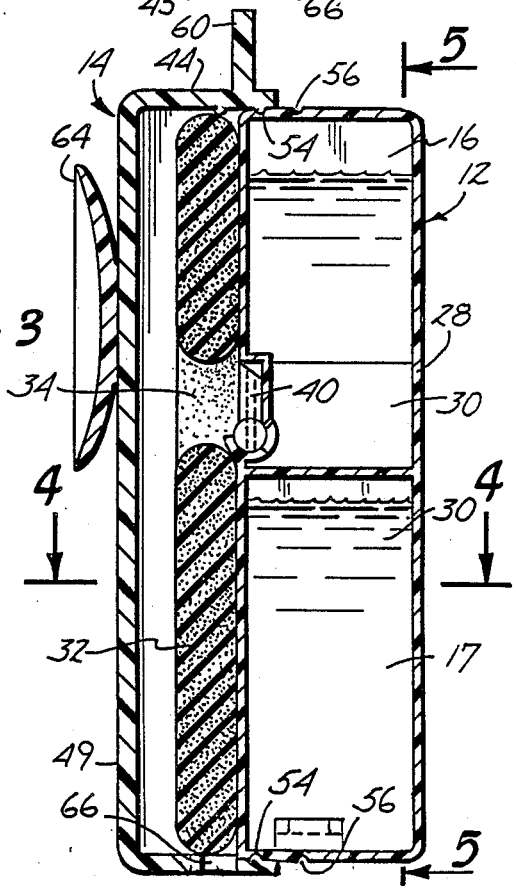
FIG. 3 is a vertical sectional view also taken on the line 2—2 in FIG. 1 but showing the unit in condition for dispensing shampoo or creme rinse and for allowing water and liquid soap to drain from a sponge forming part of the unit.

As seen in FIGS. 2 and 3, a suction cup 50 is permanently attached to the back wall 49 of the case 14.

The configuration of the valves, and particularly the shampoo valve 41 and creme rinse valve 42 is such that when they are in the closed position, they fit entirely within the container 12. Thus, when the container is in its storage position with respect to the case, as seen in FIGS. 1 and 2, for example, the bottom wall 45 of the case 14 will prevent deliberate or accidental opening of either of the valves 41 or 42. The back wall 49 of the case prevents access to soap dispenser valve 40 when the container is in storage position in the case.

Figure 4:
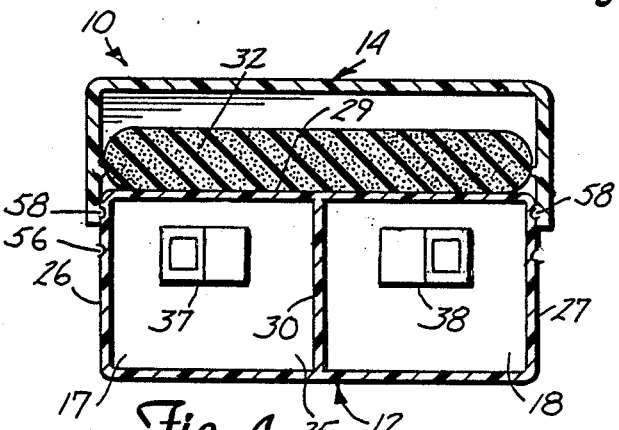
FIG. 4 is a horizontal sectional view taken on the line 4—4 in FIG.3.

Fastening means are provided to temporarily fixedly position the container 12 and the case 14 with respect to each other in the storage position as illustrated in FIG. 2 and in the soap and water drain position as seen in FIGS. 3 and 4. In the form of the invention as shown, this means is illustrated as including a first positioning groove 54 in the resilient top, bottom and side walls around the entire outer periphery of the reilient container 12; a second storage positioning groove 56 also provided around the entire periphery of the container 12 in spaced parallel relation to the first groove 54; and a single tongue 58 extending integrally inwardly from the inner surfaces of the top, bottom and side walls of the case 14 and adapted to fit alternately in either of the grooves 54 or 56.

When the unit and the fluids in it are to be stored, the case 14 will be associated with the container 12 as seen in FIG. 2. with the tongue 58 in second positioning groove 56. When the unit is to be used for washing, the case can be affixed by suction cup 50 to a vertical side wall (for example, a bathroom tile), and the container 12 will be removed from it. Valve 40 will be opened, the sponge wet and soap squeezed out onto the sponge. After the container and sponge have been used for washing, the container will be repositioned inside of the case hanging from the bathroom wall with the tongue 58 in the first positioning groove 54 as seen in FIGS. 3 and 4, to allow liquid soap and water to drain through an opening 66 provided in the bottom wall 45 of the case.

A hanger strap 60 extends upwardly and outwardly from the top wall 44 of the case 14 and is provided with an opening 61 therethrough to receive a hanger cord by which a bather could suspend the unit 10 from a hook, or from around his neck where no smooth surfaces capable of receiving and holding a suction cup are available.

OPERATION

A method of using a portable personal liquid storage and dispensing unit made according to the invention can include first pressing the unit 10 and its suction cup 50 against a smooth area of bathroom wall adjacent a shower head, for example. Next, the container 12 can be removed from the case 14, the soap dispenser valve 40 opened, and the flexible and resilient container 12 squeezed to tend to reduce the total volume in the container. This tendency to reduce the size of the shampoo container 17 and creme rinse container 18 will cause the resilient wall 30 to flex in direction toward the liquid soap compartment 16, and deflection of the other resilient walls bounding the soap compartment 16 will combine to cause liquid soap to be dispensed through port 36 and valve 40. This liquid soap will enter the sponge 32 through the soap access opening 34 in the sponge, and when mixed with water from the shower head, will allow the sponge to be used to scrub the body of the user. When no further soap is needed or desired, valve 40 will be closed, and the container-mounted sponge can be rinsed and used to rinse the user's body. After the user's hair has been wetted, and the resilient container fitted into the wall-mounted case to cause the tongue 58 to snap into position in alignment with the first positioning groove 54, the shampoo dispenser valve 41 can be opened, and the resilient walls of the container manually deformed to develop a pressure inside of the shampoo compartment 17 which will cause shampoo to be dispensed through the port 37 and valve 41.

The user will collect this shampoo in his hand, and apply it to his head to shampoo in any usual or desired manner.

When sufficient shampoo has been dispensed, valve 41 will be closed; and when creme rinse is needed, valve 42 will be opened. Manual pressure will again be applied to the container 12 to dispense creme rinse through its dispenser port and valve onto the hand of the user.

From the time the container 14 has been snapped into position as determined by tongue 58 and the first positioning groove 54, any fluid including water or liquid soap in the area of the sponge will drain down the sides of the sponge and between the back walls 29 and 49, and will drip through the drain opening 66 in the bottom wall 45 of the case 14 to flow harmlessly down the side of the bathroom wall beneath the unit 10.

When sufficient creme rinse has been dispensed, the resilient container 12 will be moved further back against the case 14 to cause the peripheral tongue 58 to snap from the first groove 54 into the second positioning groove 56. This will move the bottom wall 45 of the case 14 into interfering relationship with the closed shampoo dispenser valve 41 and creme rinse dispenser valve 42 thus preventing them from opening accidentally or by design while the unit is in its storage condition. This movement will also cause the drain opening 66 to be moved into contacting sealing relationship with the outside surface of the bottom wall 25 of the container 12, thus preventing any further leakage of any fluids in the sponge compartment from the unit while it is stored.

Although the present invention has been described with reference to preferred embodiments, workers skilled in the art will recognize that changes may be made in form and detail without departing from the spirit and scope of the invention.

What is claimed is:

1. A unit for storage and dispensing fluids including:

(a) an at least partially resilient container encompassing a plurality of separate, fluid tight, fluid containing compartments at least partially defined by deformable walls, each compartment being in intimate contact with at least one other compartment;

(b) a normally closed, openable port extending away from each such compartment;

(c) wherein the container includes a deformable wall which is manually deformable to tend to reduce the volume of each compartment to develop a pressure in each compartment such that fluid will be dispensed through any compartment port that is open while the other ports remain normally closed;

(d) wherein the container is rectilinear in shape and includes front and back walls, top and bottom walls, and first and second side walls; and (e) wherein the compartments are each partially defined by the front and back container walls;

(f) the front wall of he container is a resilient flexible wall;

(g) there are at least three compartments within the container walls; and (h) the normally closed, openable ports of two of the compartments open through the container bottom wall while the normally closed, openable port of the third compartment is open though the container back wall;

(i) the unit includes an open face case of rectilinear configuration to encompass at least a portion of the container by covering the back wall and snugly contacting at least portions of the container top, bottom and side walls; the open face case and the container including cooperating means for retaining the container in a first storage position wherein the openable ports at the container bottom wall are free from obstruction by the open face case and for retaining the container in a second storage position wherein the openable ports at the container bottom wall are covered by the open face case.

2. The unit of claim 1 wherein:

(j) means is provided to temporarily fixedly hold the case with respect to the container in a storage condition;

(k) each port is controlled by a valve; and (l) each of the valves opening through the bottom wall of the container is pivotally mounted in the container bottom wall to be movable between a normally closed position and an open position, and when in the normally closed condition, is positioned within the outer surface of the container bottom wall so that the adjacent portion of the case will lie in interfering relation to such valve to prevent its opening when the container is in its second storage position.

3. A unit for storage and dispensing fluids including:

(a) an at least partially resilient container encompassing a plurality of separate, fluid tight, fluid containing compartments at least partially defined by deformable walls, each compartment being in intimate contact with at least one other compartment;

(b) a normally closed, openable port extending away from each such compartment;

(c) wherein the container includes a deformable wall which is manually deformable to tend to reduce the volume of each compartment to develop a pressure in each compartment such that fluid will be dispensed through any compartment port that is open while the other ports remain normally closed;

(d) wherein the container is rectilinear in shape and includes front and back walls, top and bottom walls, and first and second side walls;

(e) wherein the compartments are each partially defined by the front and back container walls;

(f) wherein the front wall of the container is a resilient flexible wall;

(g) wherein there are at least three compartments within the container walls;

(h) wherein the normally closed, openable ports of two of the compartments are open through the container bottom wall while the normally closed, openable port of the third compartment is open through the container back wall;

(i) wherein the unit includes an open face case of configuration to encompass at least a portion of the container by snugly contacting at least portions of the container top, bottom and side walls;

(j) wherein means is provided to temporarily fixedly hold the case with respect to the container in a storage condition;

(k) wherein each port is controlled by a valve;

(l) wherein each of the valves opening through the bottom wall of the container is pivotally mounted to the container bottom wall to be movable between a normally closed position and an open position, and when in the normally closed condition, is positioned within the outer surface of the container bottom wall so that the adjacent portion of the case will lie in interfering relation to such valve to prevent its opening when the container is in its storage condition; and (m) wherein the means provided for holding the case and container in storage condition includes ridge means extending inwardly from the case portions in snug contact with at least one of the container top, bottom or side walls, and interacting aligned detent means on at least one of said container walls.

4. The unit of claim 3 wherein:

(n) each of the container top, bottom and side walls is resilient;

(o) the case is defined by a back wall, bottom and top walls, and first and second side walls all configured to come into adjacent relationship with respect to the corresponding walls of the container when the case encompasses at least a portion of the container;

(p) the case ridge means extends inwardly from the case top, bottom and side walls around the entire periphery of the case; and (q) the container detent means includes a storage condition positioning groove in the resilient container top, bottom and side walls around the entire periphery of the container, the groove being positioned to interact with the case ridge means to temporarily fixedly position the unit in its storage condition.

5. A unit for storage and dispensing fluids including:

(a) an at least partially resilient container encompassing a plurality of separate, fluid tight, fluid containing compartments at least patially defined by deformable walls, each compartment being in intimate contact with at least one other compartment;

(b) a normally closed, openable port extending away from each such compartment;

(c) wherein the container includes a deformable wall which is manually deformable to tend to reduce the volume of each compartment to develop a pressure in each compartment such that fluid will be dispensed through any compartment port that is open while the other ports remain normally closed;

(d) wherein the container is rectilinear in shape and includes front and back walls, top and bottom walls, and first and second side walls;

(e) wherein the compartments are each partially defined by the front and back container walls;

(f) wherein the front wall of the container is a resilient flexible wall;

(g) wherein there are at least three compartments within the container walls;

(h) wherein the normally closed, openable ports of two of the compartments are open through the container bottom wall while the normally closed, openable port of the third compartment is open through the container back wall;

(i) wherein the unit includes an open face case of configuration to encompass at least a portion of the container by snuggly contacting at least portions of the container top, bottom and side walls;

(j) wherein means is provided to temporarily fixedly hold the case with respect to the container in a dispensing condition to dispense fluid through the container bottom wall;

(k) wherein each port is controlled by a valve;

(l) wherein a sponge of generally rectangular configuration is attached to the back wall of the container, and an opening is provided in the sponge to accommodate the movement of the valve which opens through that back wall between its normally closed and open positions;

(m) wherein the case is defined by a back wall, bottom and top walls, and first and second side walls all configured to come into adjacent relationship with respect to the corresponding walls of the container when the case receives the container; and (n) wherein a suction cup extends outwardly from the rear wall of the case in position to support the case and container against a smooth wall such as a vertical bathroom wall during the time that liquids are to be dispensed through the container bottom wall and the sponge is not being used, and to support the case when liquid is to be dispensed through the container back wall and the sponge is to be used.

6. The unit of claim 5 wherein:

(o) the means provided for holding the case and container in dispensing condition includes ridge means extending inwardly from the case portions in snug contact with at least one of the container top, bottom or side walls, and interacting aligned detent means on at least one of said container walls.

7. The unit of claim 6 wherein:

(p) each of the container top, bottom and side walls is resilient;

(q) the case is defined by a back wall, bottom and top walls, and first and second side walls all configured to come into adjacent relationship with respect to the corresponding walls of the container when the case encompasses at least a portion of the container, the case bottom wall being provided with a fluid drain opening situated between the case and container back walls when the unit is in its dispensing condition;

(r) the case ridge means extends inwardly from the case top, bottom and side walls around the entire periphery of the case; and (s) the container detent means includes a dispensing condition positioning groove in the resilient container top, bottom and side walls, the groove being positioned to interact with the case ridge means to temporarily fixedly position the unit in its dispensing condition.

8. The unit of claim 7 wherein:

(t) means is provided to temporarily fixedly hold the case with respect to the container in a storage condition, said means including said case ridge means and a storage condition positioning groove in the resilient container top, bottom and side walls around the entire perihery of the container in parallel relation to the dispensing condition positioning groove; and (u) the case bottom wall drain opening is in closing relation to the container bottom wall when the unit is in storage condition to prevent fluid from discharging from between the case and container walls when in that condition.

* * * * *